US007988118B2

(12) United States Patent
Shye

(10) Patent No.: US 7,988,118 B2
(45) Date of Patent: Aug. 2, 2011

(54) MODULAR SUSPENDED WINE BOTTLE HOLDER

(76) Inventor: Joshua Shye, Zichron Yaakov (IL)

( * ) Notice: Subject to any disclaimer, the term of this patent is extended or adjusted under 35 U.S.C. 154(b) by 384 days.

(21) Appl. No.: 12/324,222

(22) Filed: Nov. 26, 2008

(65) Prior Publication Data

US 2009/0140115 A1 Jun. 4, 2009

Related U.S. Application Data

(60) Provisional application No. 60/996,666, filed on Nov. 29, 2007.

(51) Int. Cl.
*A47H 1/10* (2006.01)

(52) U.S. Cl. ..... 248/318; 248/317; 248/328; 248/59; 211/75; 211/74; 211/85.29; 211/85.18

(58) Field of Classification Search ..... 248/318, 248/317, 328, 102, 58, 59; 211/75, 74, 76, 211/113, 123, 64, 85.18; 182/196; 206/65; 224/148, 4, 578, 926
See application file for complete search history.

(56) References Cited

U.S. PATENT DOCUMENTS 1,014,004 A * 1/1912 Irwin ..... 248/102
2,744,668 A * 5/1956 Henigman ..... 294/154
3,746,179 A * 7/1973 Paumgardhen ..... 211/75
4,798,286 A * 1/1989 Muscanelli ..... 206/150
5,826,731 A 10/1998 Dardashti

FOREIGN PATENT DOCUMENTS

WO WO 99/53807 10/1999

* cited by examiner

*Primary Examiner* — Terrell Mckinnon
*Assistant Examiner* — Todd M. Epps
(74) *Attorney, Agent, or Firm* — Merchant & Gould P.C.

(57) ABSTRACT

A suspended bottle holder has substantially vertically disposed first and second straps, each of which has an upper strap portion and a lower strap portion. A bottle base holding loop has proximal and distal longitudinal ends, the bottle base holding loop being attached to the upper and lower portions of the first strap, for engaging at least a portion of a bottle base. A bottle neck holding loop has proximal and distal longitudinal ends, the bottle neck holding loop being attached to the upper and lower portions of the second strap, for engaging at least a portion of a neck of the bottle. A connector connects the first and second straps to a structural member. The bottle base holding loop and the bottle neck holding loop are sufficiently spaced and the first and second straps are of a substantially equal length both when a bottle is removed from, or received in, the bottle base and bottle neck holding loops, so as to maintain the bottle in a substantially horizontal disposition.

23 Claims, 11 Drawing Sheets

MODULAR SUSPENDED WINE BOTTLE HOLDER

This application claims benefit of Ser. No. 60/996,666, filed Nov. 29, 2007 in the United States and which application is incorporated herein by reference. To the extent appropriate, a claim of priority is made to the above disclosed application.

FIELD OF THE INVENTION

The present invention relates to hanging racks, stands, or holders for cradling, generally horizontally, wine bottles or the like and for the securing of containers such as bottles for wines and liquors and the maintenance thereof in substantially horizontal position. More particularly, the present invention relates to modular wine bottle holders that are suspended, foldable and portable, and to methods of assembling them.

BACKGROUND OF THE INVENTION

Various devices have been developed that relate to bottle holders and the like. U.S. Pat. No. 3,746,179 discloses hanging racks for the securing of containers such as bottles for wines and liquors and the maintenance thereof in substantially horizontal position, in such manner that the labels are in full view and the position of the containers may be adjusted by loosening or tightening the retaining members forming a part of the rack.

U.S. Pat. No. 5,826,731 discloses a wine rack with four wire panels of bottle holders and a wire base assembly, each being a separate component and packaged together in a small carton. The two lower panels are fitted into the base assembly, the two upper panels are fitted into the tops of respective lower panels, and the panels are all clipped together. The two lower panels are also cradled in a cross bar of the base assembly. All of the bottles, when held in storage positions in the rack, are sloped downwardly at an angle towards their cork ends. The bottles on one panel-column side face one direction and those on the other face the other direction. The entire unit with its snap-fit and clipped connections and its balanced bottle arrangement can be safely lifted at its top when fully loaded with bottles.

WO 99/53807 discloses a bottle carrier especially for wine bottles, that comprises frame with end stop opposite compression spring between which bottle is placed, frame vertical part tops terminated by hooks and bottom cross member having complementary fixing grooves. The carrier consists of a modular system for maintaining pressed, horizontally and suspended one or several bottles with their labels still visible. It consists of a frame with a stop device and a compression spring between which are respectively engaged a bottle base and neck. The distance between the stop device and the cylindrical spring is such that it maintains the inserted bottle pressed. Each frame has at its lower level on the crosspiece two grooves, and at its upper level two hooks designed to cause the modules to be mutually locked. The centre-to-centre spacing between the hooks is slightly greater then the centre-to-centre spacing between the grooves.

All the methods described above have not yet provided satisfactory solutions to the problem of securing of containers such as bottles for wines and liquors and the maintenance thereof in substantially horizontal position.

It is an object of the present invention to provide a method and apparatus for securing of containers such as bottles for wines and liquors and the maintenance thereof in substantially horizontal position, which is reliable, foldable.

It is another object of the present invention to provide a method and apparatus for the securing of containers such as bottles for wines and liquors, in which the substantially horizontal position of bottles is maintained even after one or more bottles are removed.

Other objects and advantages of the invention will become apparent as the description proceeds.

SUMMARY OF THE INVENTION

The present invention is directed to a suspended bottle holder that comprises:

a) substantially vertically disposed first and second straps, each of which having an upper strap portion and a lower strap portion;

b) a bottle base holding loop having proximal and distal longitudinal ends, the bottle base holding loop being attached to the upper and lower portions of the first strap, for engaging at least a portion of a bottle base; a bottle neck holding loop having proximal and distal longitudinal ends, the bottle neck holding loop being attached to the upper and lower portions of the second strap, for engaging at least a portion of a neck of the bottle; and c) connecting means for connecting the first and second straps to a structural member, wherein the bottle base holding loop and the bottle neck holding loop are sufficiently spaced so as to maintain the bottle in a substantially horizontal disposition.

The bottle base holding loop and the bottle neck holding loop may be connected to the first and second straps, respectively, at one connection point and may be connected to the first and second straps, respectively, at two connection points. The bottle base holding loop and bottle neck holding loop may be made of elastic material.

The first and second straps may be of a substantially equal length both when a bottle is removed from, or received in, the bottle base and bottle neck holding loops.

The bottle base holding loop and bottle neck holding loop may be entirely or partially made of inelastic material.

The bottle holder may further comprise a connecting strap with a segment substantially parallel to the longitudinal axis of the bottle for connecting the first and second straps.

The connecting strap may be connected to both the bottle base holding loop and the bottle neck holding loop. Alternatively, the connecting strap may be connected at a first connecting point to a first circumferential portion of the bottle neck holding loop, at a second connecting point to a first circumferential portion of the bottle base holding loop, and at a third connecting point to a second circumferential portion of the bottle base holding loop, the first circumferential portion of each of the bottle base holding loop and of the bottle neck holding loop being on a common transversal side of the longitudinal axis of the bottle and the second circumferential portion of the bottle base holding loop being on a transversal side of the longitudinal axis of the bottle which is opposite to that of the first circumferential portion of the bottle neck holding loop.

The connecting strap may longitudinally extend from the second connecting point, away from the bottle neck holding loop (herein "distally"), transversally extend to the second circumferential portion of the bottle base holding loop, and be connected at the distal longitudinal end of the bottle base holding loop. The second and the third connecting points may be common longitudinal ends of the bottle base holding loop and may be different longitudinal ends of the bottle base holding loop.

The connecting strap may be further connected to the bottle base holding loop at a fourth connection point located at the distal longitudinal end of the first circumferential portion of the bottle base holding loop, the second connection point being located at the longitudinal end closer to the bottle neck holding loop (herein "proximal") of the first circumferential portion of the bottle base holding loop.

The length of the connecting strap, when not stretched, between the first and second connection points and between the third and fourth connection points may be such that the bottle base is insertable in the bottle base holding loop and that the bottle neck is insertable in the bottle neck holding loop after the connecting strap is stretched.

The connection strap segment may be inelastic between the first and second connection points or between the third and fourth connection points. The connecting strap may be releasably attachable to the bottle neck holding loop.

First and second circumferential portions of the bottle base holding loop or of the bottle neck holding loop may be releasably attachable to each other.

The bottle holder system may comprise a plurality of bottle holders, wherein an upper bottle holder is connected to a structural member and a lower bottle holder is connected to a bottle holder located thereabove. Each bottle holder may further comprise a supporting strap attached to the upper strap portions of the first and second straps, respectively, or to the lower strap portions of the first and second straps, respectively.

BRIEF DESCRIPTION OF THE DRAWINGS

The above and other characteristics and advantages of the invention will be better understood through the following illustrative and non-limitative detailed description of preferred embodiments thereof, with reference to the appended drawings, wherein.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided, so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The methods and examples provided herein are illustrative only and not intended to be limiting.

By way of introduction, the principal intentions of the present invention include providing a modular suspended bottle holder, for example a wine bottle. One bottle holder can be attached to either affixed hooks on a wall or ceiling, or to another bottle holder, according to the present invention.

Figure 1:
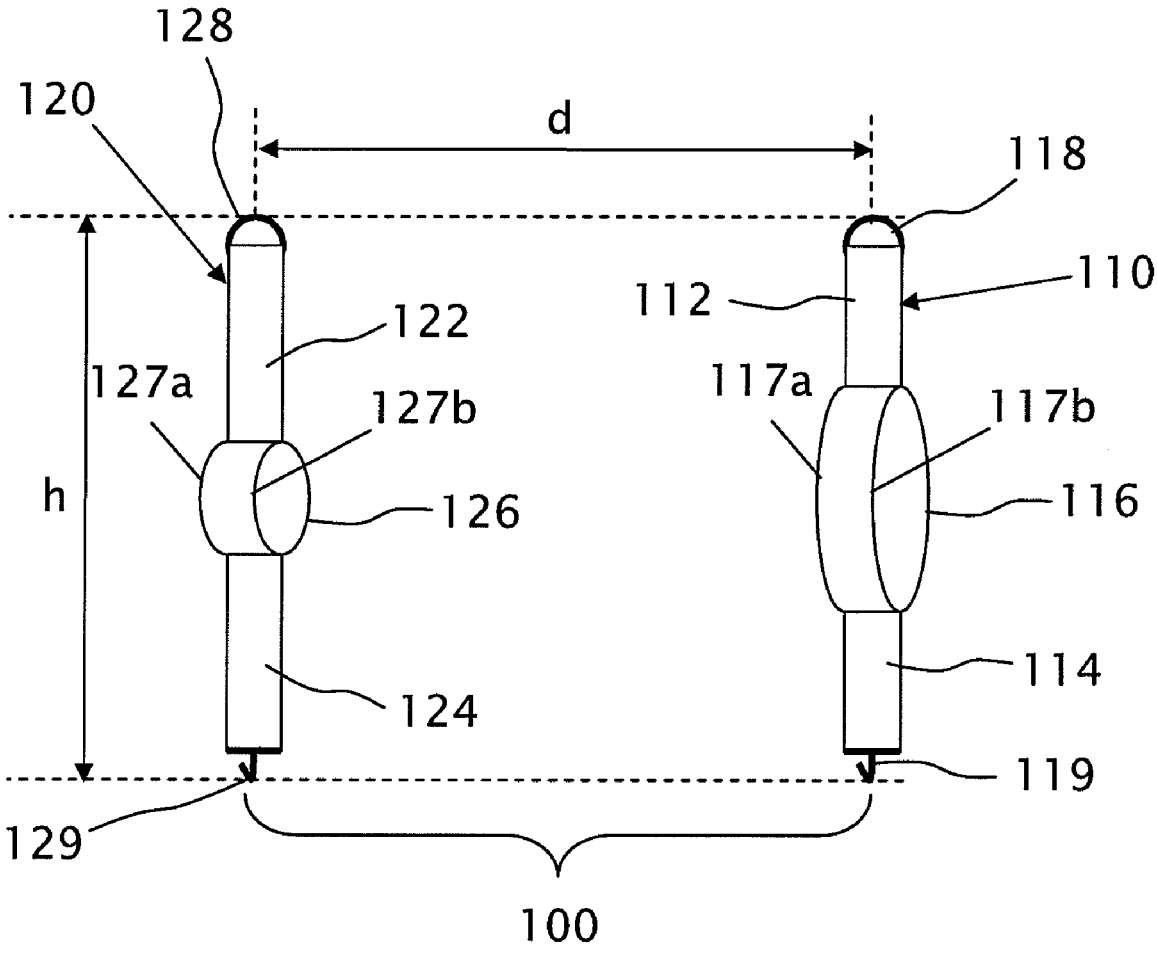
FIG. 1 illustrates a first and a second straps with holding loops, according to embodiments of the present invention, the first strap designed to hold the base end of the bottle and the second strap designed to hold the neck end of the bottle.

Reference is now made to the drawings. FIG. 1 illustrates a bottle holder 100, having a first strap 110 with holding loop 116; and a second strap 120 with holding loop 126, according to embodiments of the present invention. First strap 110 is designed to hold the base end of a bottle, herein referred to as base strap 110, and second strap 120 is designed to hold the neck end of the bottle, herein referred to as neck strap 120. Base strap 110 includes an upper strap portion 112, a lower strap portion 114 and a holding loop 116. Neck strap 120 includes an upper strap portion 122, a lower strap portion 124 and a holding loop 126. Holding loop 116, which has proximal 117*a* and distal 117*b* longitudinal ends, should be wide enough to host the bottom part of the base of target bottles. Holding loop 126, which has proximal 127*a* and distal 127*b* longitudinal ends, should be wide enough to host the neck part of the neck of target bottles. In embodiments of the present invention loops 126 and/or 116 are made of elastic (stretchable) materials and thereby can fit to wide variety of bottle sizes.

In other embodiments of the present invention loops 126 and/or 116 are made of non-elastic (non-stretchable) or rigid materials (for example, plastic, metal or non-elastic fabric) and thereby fit to limited variety of bottle sizes.

A hook 119 is disposed at the end of lower strap portion 114 and a connecting loop 118 is disposed at the end of upper strap portion 112. A hook 129 is disposed at the end of lower strap portion 124 and a connecting loop 128 is disposed at the end of upper strap portion 122. In other embodiments of the present invention, hook 119 is disposed at the end of upper strap portion 112 and a connecting loop 118 is disposed at the end of lower strap portion 114. Respectively, hook 129 is disposed at the end of upper strap portion 122 and a connecting loop 128 is disposed at the end of lower strap portion 124. Hooks 119/129 and coupling connecting loops 118/128 are connecting means given by way of example only and any other connecting means such as buckles, clasps, or Velcro straps can be used.

Figure 2:
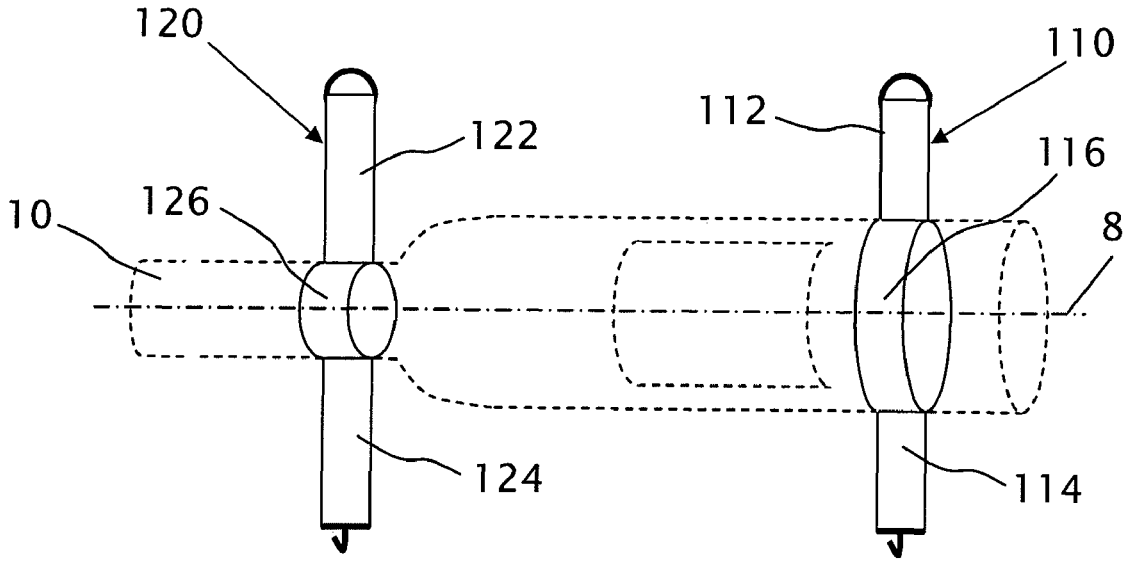
FIG. 2 illustrates the base and neck straps shown in FIG. 1, holding a bottle horizontally.

Reference is now made to FIG. 2, which illustrates bottle holder 100, shown in FIG. 1. The positioning of loops 116 and 126 are such the bottle 10 having a longitudinal axis 8 is kept substantially horizontal. In this embodiment, the positioning of loops 116 and 126 along straps 110 and 120 respectively can be higher or lower, as long as bottle 10 is kept substantially horizontal. The distance d, shown in FIG. 1, between strap 110 and strap 120 should be such that bottle 10 is held in holding device 100 safely and comfortably.

Figure 3:
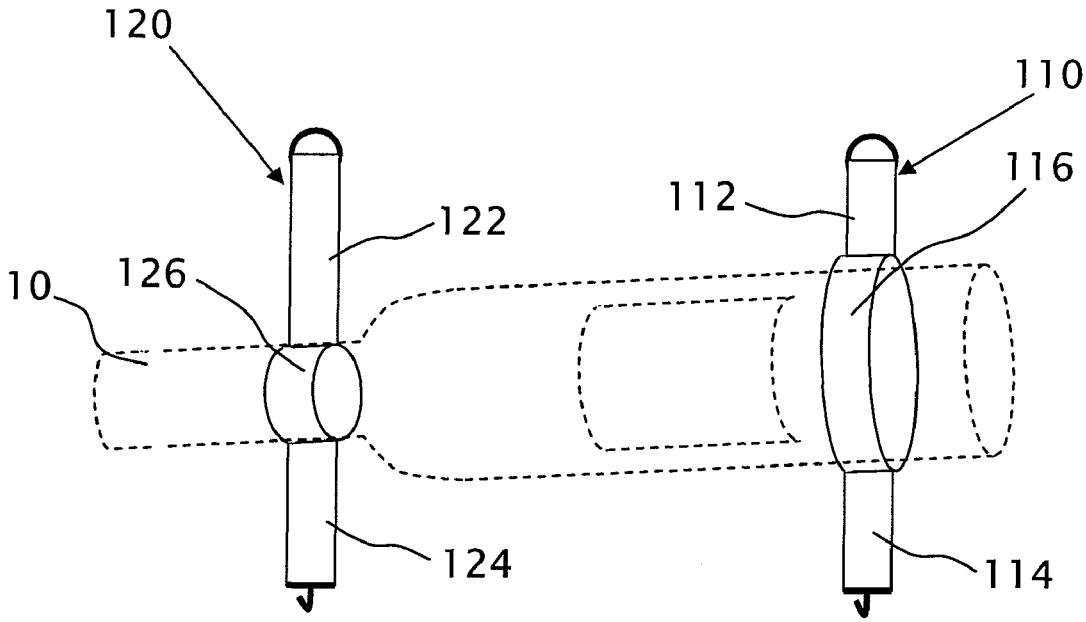
FIG. 3 illustrates the base and neck straps shown in FIG. 1, whereas the loops are disposed on the straps such that they hold the bottle slightly diagonal.

Another embodiment of the present invention is shown on FIG. 3, which illustrates the base and neck straps shown in FIG. 1, whereas loops 116 and 126 are disposed on the straps such that they hold bottle 10 slightly diagonal, whereas the neck side of bottle 10 is slightly lower.

In one embodiment of the present invention, base strap 110 is formed by first creating a loop 116 and then attaching to loop 116 upper strap portion 112 and lower strap portion 114. In another embodiment of the present invention, base strap 110 is formed by taking a single long strap, and attaching to the long trap a shorter strap, having a measured length. The short strap can be attached to the long strap anywhere along the long strap, except the ends. The short strap can be attached to the long strap at a single location or in two locations, the two locations being apart by a pre-measured distance. The attaching method can be any method known in the art such as sawing, gluing or any other way suited for the materials the straps are made of. Neck strap 120 is formed the same way base strap 110 is formed. The above description of ways to form straps 110/120 are given by way of example only and in other embodiments of the present invention, other ways known in the art can be used to form these straps.

Figure 4:
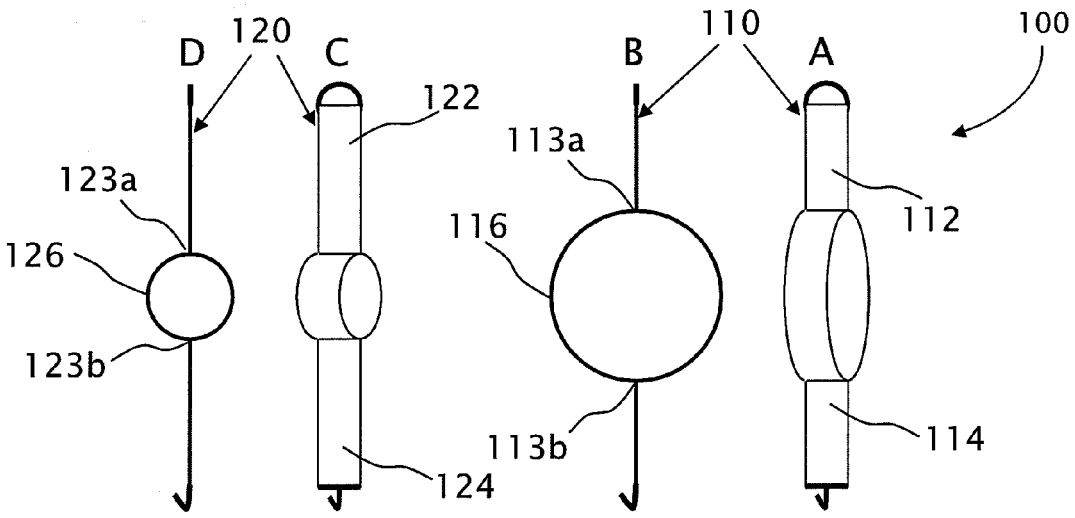
FIG. 4A is a front prospective view of the base strap shown in FIG. 1.
FIG. 4B is a side view of the base strap shown in FIG. 1.
FIG. 4C is a front prospective view of the neck strap shown in FIG. 1.
FIG. 4D is a side view of the neck strap shown in FIG. 1.
Figure 5:
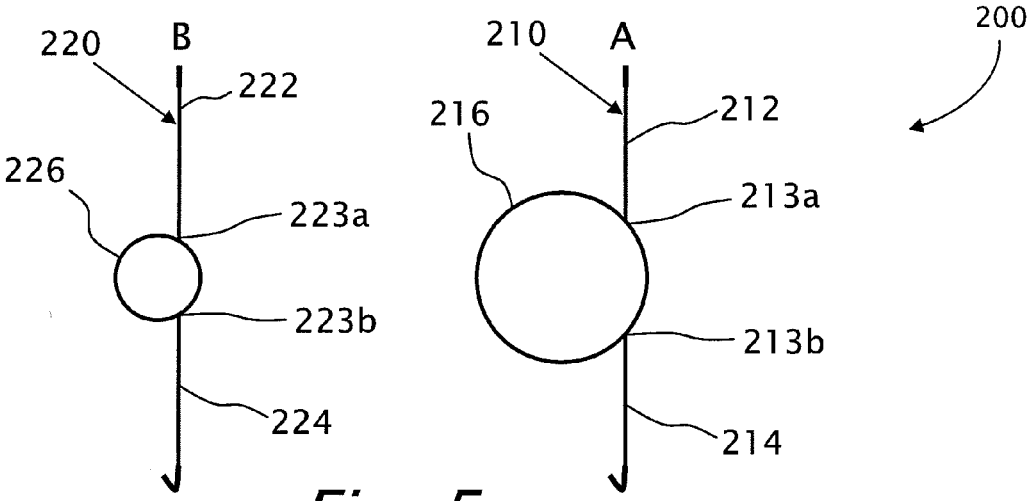
FIG. 5A is a side view of the base strap, according to other embodiments of the present invention.
FIG. 5B is a side view of the neck strap coupled with the base strap shown in FIG. 5A.
Figure 6:
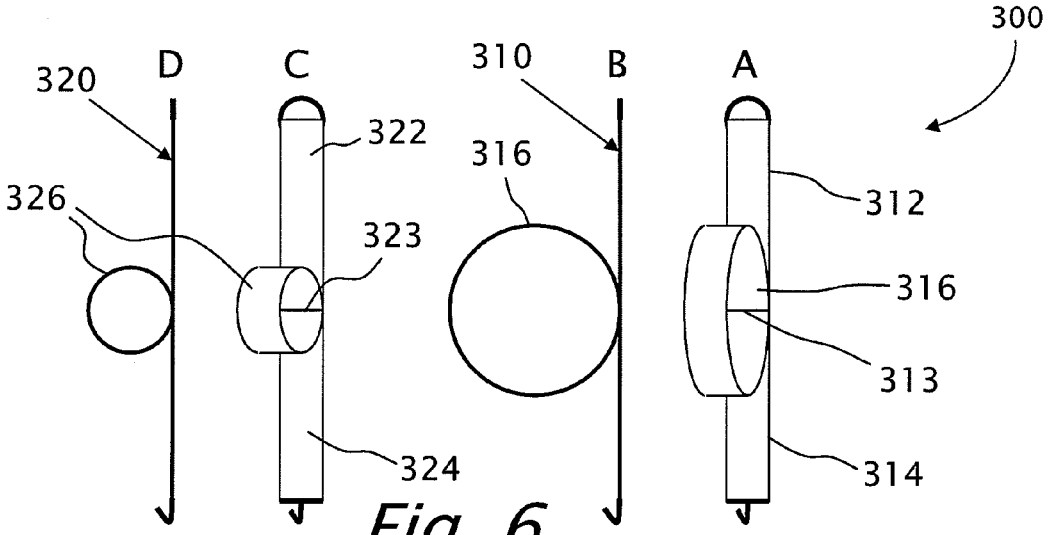
FIG. 6A is a side view of the base strap, according to other embodiments of the present invention.
FIG. 6B is a side view of the base strap shown in FIG. 6A.
FIG. 6C is the neck strap coupled with the base strap shown in FIG. 6A.
FIG. 6D is a side view of the neck strap shown in FIG. 6C.

Reference is now also made to FIGS. 4, 5 and 6 which show examples of different connection/forming of loops 116 and 126, respectively. The connectivity is better illustrated on the side views shown in FIGS. 4B/4D, 5A/5B and 6B/6D. In FIGS. 4B/4D loops 116/126 straps 112 and 114, and 122 and 124, are connected to loops 116/126 at two locations 113*a*/123*a* and 113*b*/123*b* symmetrically about the respective loop. In FIGS. 5A/5B straps 212 and 214, and 222 and 224, are connected to loops 216/226 at two locations 213*a*/223*a* and 213*b*/223*b* on the side the respective loop. In FIGS. 6B/6D straps 312 and 314, and 322 and 324, are connected to loops 316/326 at one 313/323 location on the side the respective loop.

Referring back to FIG. 1, it should be noted that the length h of straps 110 and 120 should be substantially the same. Both straps 110 and 120 should be equal in total length both when holding bottle 10 and when vacant. Thereby, if straps 110 and 120 are made from flexible materials they should extend in length to the same extent.

In embodiments of the present invention, the way to ensure that both straps 110 and 120 are equal in total length, both when holding bottle 10 and when vacant, is to make loops 116 and 126 from rigid materials so that they do not extend in length when vacant. In other embodiments of the present invention, the way to ensure an equal in total length of straps 110 and 120 is by designing the connectivity of loops 116 and 126 to straps 110 and 120 respectively.

Figure 16:
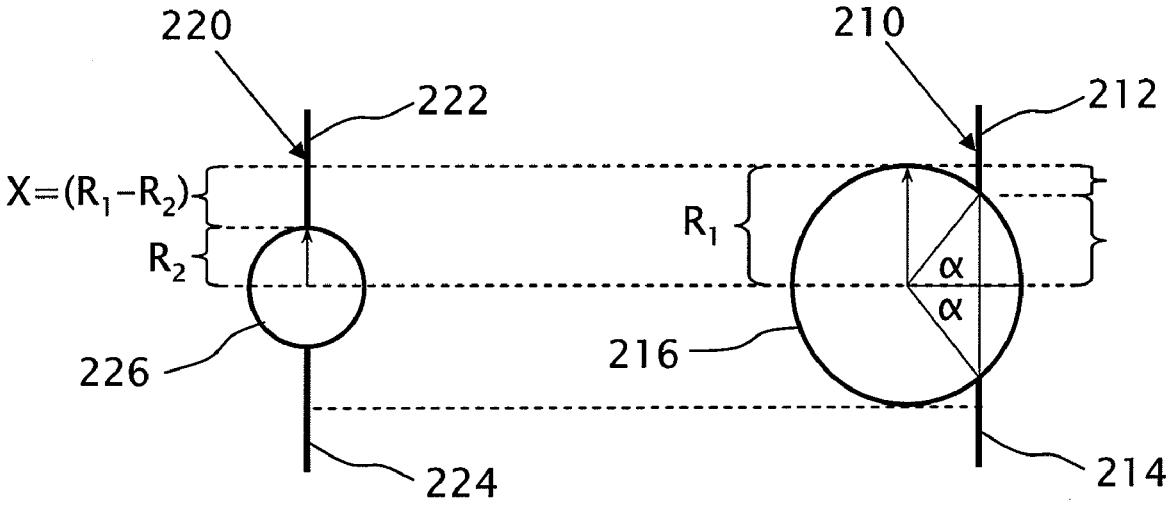
FIG. 16 illustrates parameters of the design of the base and neck straps shown in FIG. 5 such that both straps, if they are made from flexible materials, are equal in total length both when holding a bottle and when vacant and thereby extended in length.

Reference is now also made to FIG. 16 which illustrates the parameters of the design of the base and neck straps 210 and 220 shown in FIG. 5, such that both straps, if they are made from flexible materials, are equal in total length both when holding a bottle and when vacant. This enables using flexible materials for straps 110 and 120 and loops 116 and 126. When loops 116 and 126 are made of flexible, inelastic material, the length of straps 110 and 120 will increase after the bottle is removed from the loops.

According to the present invention, $\alpha$ is computed as follows:

The difference in loops 216 and 226 radiuses is:

$$X=(R1-R2);$$

L1, which is ½ of the final length of the vacant strap 110, is computed by:

$$L1=(\alpha/360°)\times(2\times\pi\times R1)+(R1-R1\times\mathrm{Sin}\ \alpha);$$

L2, which is ½ of the final length of the vacant strap 120, is computed by:

$$L2=(2\times\pi\times R2)/4+X;$$

Setting:

$$L1=L2$$

Implies:

$$(\alpha/360°)\times(2\times\pi\times R1)+(R1-R1\times\mathrm{Sin}\ \alpha)=(2\times\pi\times R2)/4+(R1-R2);$$

Example:

$$R1=3.5\ \mathrm{cm};$$

$$R2=1.5\ \mathrm{cm};$$

$$X=R1-R2=3.5-1.5=2\ \mathrm{cm};$$

Substituting:

$$(\alpha/360°)\times(2\times3.1415\times3.5)+(3.5-3.5\times\mathrm{Sin}\ \alpha)=(2\times3.1415\times1.5)/4+(3.5-1.5)$$

Yields:

$$\alpha=66.6°$$

(End of Example)

In embodiments of the present invention, loops 116/126, 216/226, 316/326, 416/426 or a portion thereof are made of rigid materials and thereby respective straps pairs 110/120, 210/220, 310/320, 410/420 are kept in fixed and equal length.

Figure 7A:
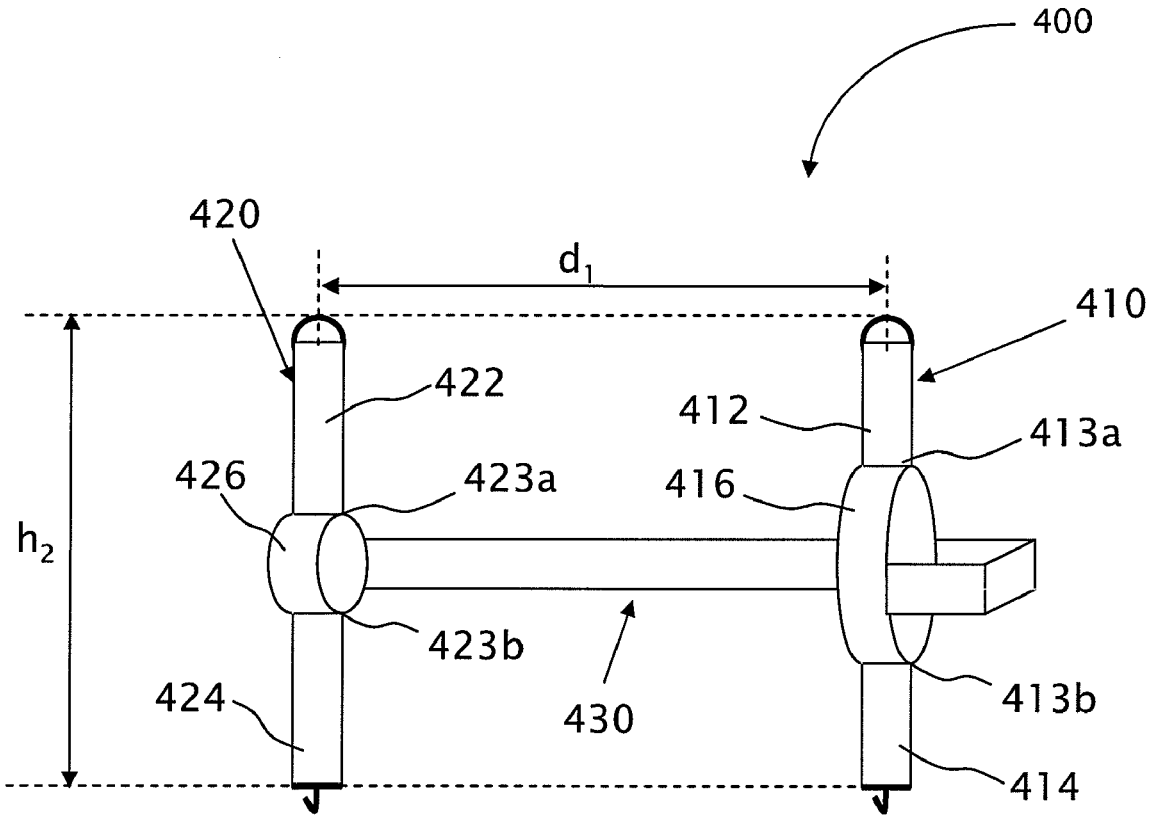
FIG. 7*a* illustrates a single bottle holder, according to embodiments of the present invention, the first strap designed to hold the base end of the bottle and the second strap designed to hold the neck end of the bottle.
Figure 7B:
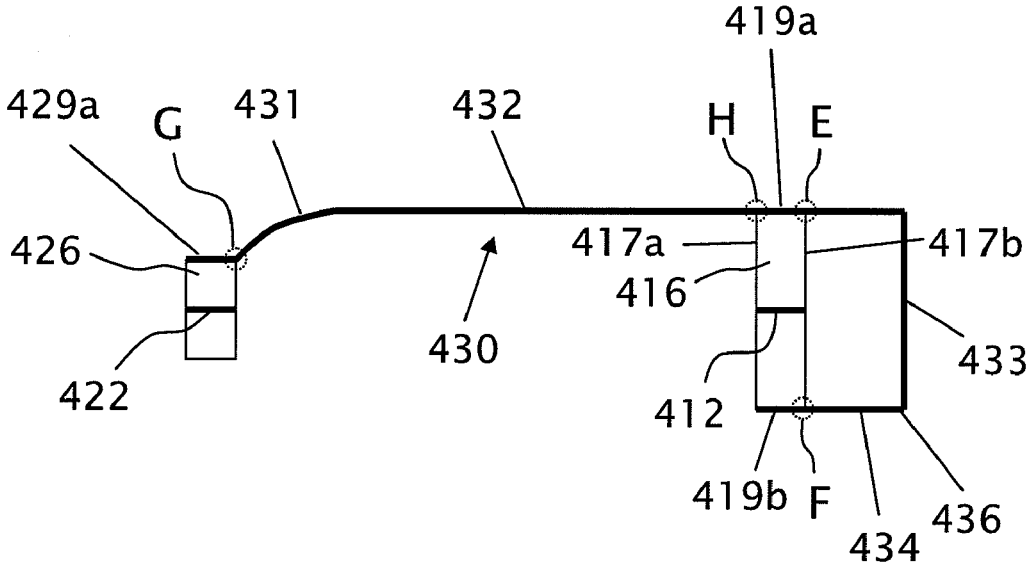
FIG. 7*b* is a top view of the single bottle holder shown in FIG. 7*a;*

Reference is now made to FIG. 7*a* which illustrates a single bottle holder 400, according to embodiments of the present invention. FIG. 7*b* is a top view of bottle holder 400 shown in FIG. 7*a*. Bottle holder 400 includes a first strap 410 with holding loop 416; and a second strap 420 with holding loop 426, according to embodiments of the present invention. First strap 410 is designed to hold the base end of a bottle, herein referred to as base strap 410, and second strap 420 is designed to hold the neck end of the bottle, herein referred to as neck strap 420. Base strap 410 includes an upper strap portion 412, a lower strap portion 414 and a holding loop 416. Neck strap 420 includes an upper strap portion 422, a lower strap portion 424 and a holding loop 426. Holding loop 416 should be wide enough to host bottom part of the base of target bottles. Holding loop 426 should be wide enough to host the neck part of the neck of target bottles. In embodiments of the present invention loops 426 and/or 416 are made of elastic materials and thereby can fit to wide variety of bottle sizes. Straps 410 and 420 are similar to straps 110/210/310 and 120/220/320 respectively and all variations that apply to straps 110/210/310 and 120/220/320 also apply to straps 410 and 420 respectively.

Bottle holder 400 further includes a strap 430 which connects straps 410 and 420. Strap 430 can be all elastic (stretchable) or partially elastic. Strap 430, which has a segment 432 that is generally parallel to longitudinal axis 8 of the bottle 10 (FIG. 2) to be held by holder 400, is connected to straps 410 and 420 as follows: one end 431 of strap 430 that is proximal to segment 432 is connected at location G to a first circumferential portion 429*a* of holding loop 426, typically between connecting point 423*a* and 423*b*. Segment 432 is connected at location H or E or both H and E of a first circumferential portion 419*a* of holding loop 416, typically between connecting point 413*a* and 413*b*. Circumferential portions 419*a* and 429*a* are on a common transversal side of the longitudinal axis 8 of the bottle 10. Location H coincides with the proximal end 417*a* of holding loop 416 and location E coincides with the distal end 417*b* of holding loop 416. Segment 432 longitudinally extends distally from location E to segment 433. Segment 433, which is substantially parallel to distal end 417*b* of holding loop 416, transversally extends to segment 434, which is substantially parallel to segment 432. One end 436 of segment 434 is distally spaced from holding loop 416. Segment 434 longitudinally extends from end 436, and then is connected at location F coinciding with the distal longitudinal end 417*b* and the second circumferential portion 419*b* of holding loop 416, opposite to location E, typically between connecting point 413*a* and 413*b*.

The length of strap 430 between points G and H and between points E and F, when strap 430 is not stretched, is such that enables to insert a bottle base end into loop 416, stretch strap 430 and insert the bottle neck into and through loop 426.

Segment G-H of strap 430 need not be elastic if segment E-F of strap 430 is sufficiently elastic to allow the bottle insertion into holder 400, and vice versa: segment E-F of strap 430 need not be elastic if segment G-H of strap 430 is sufficiently elastic to allow the bottle insertion into holder 400.

Figure 8:
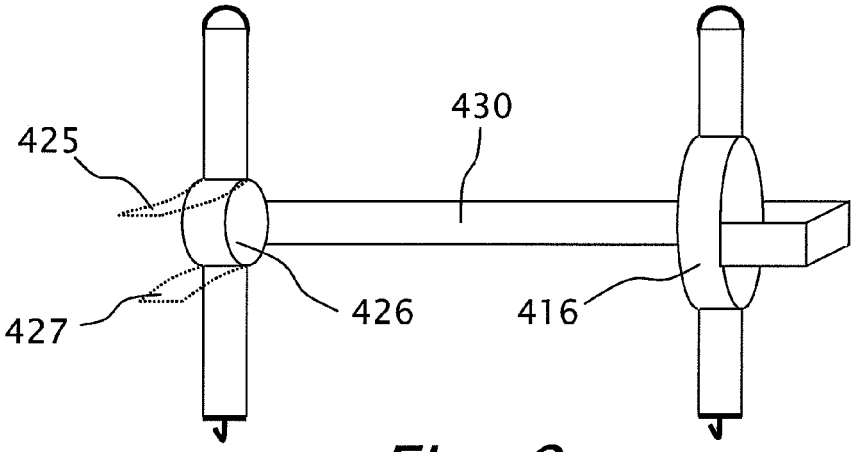
FIG. 8 illustrates the single bottle holder shown in FIG. 7*a*, whereas the neck loop holder is detachable.

Referring also to FIG. 8, which illustrates bottle holder 400, according to embodiments of the present invention, whereas neck loop holder 426 is detachable, having parts 425 and 427 capable be attached and detached, as needed. Any known way in the art to attach and detach parts 425 and 427 can be used, for example, Velcro. This enables strap 430 to be made of non-elastic materials or rigid materials, whereas when inserting a bottle into holder 400, the bottle base end is inserted into loop 416, parts 425 and 427 are detached, the bottle neck is inserted into loop 426 and 425 and 427 are reattached.

Figure 9A:
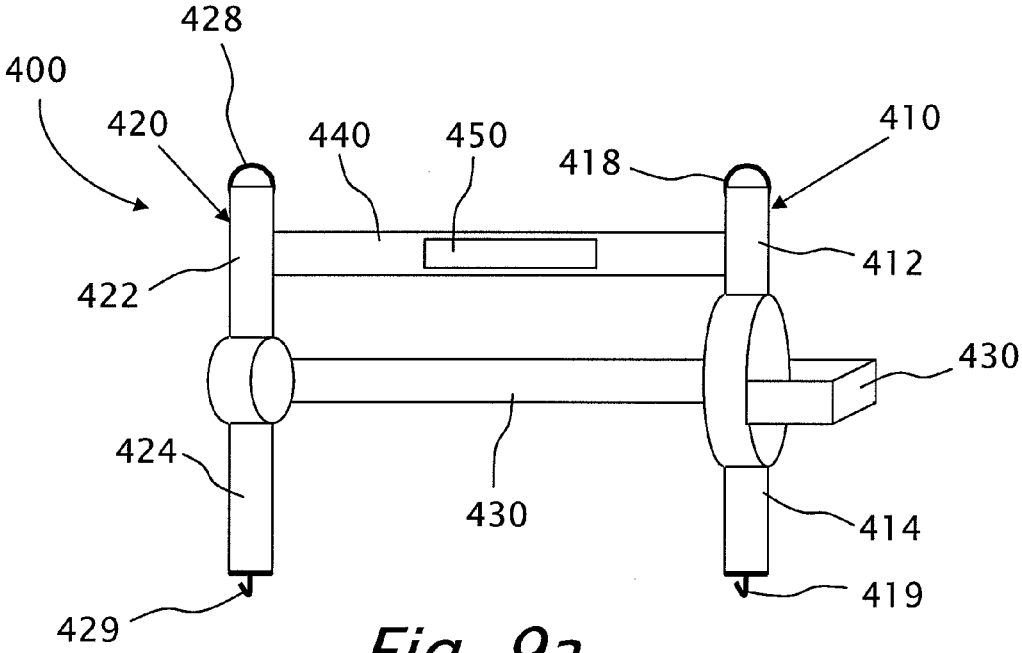
FIG. 9*a* illustrates the single bottle holder shown in FIG. 7*a*, having an additional supporting strap.
Figure 9B:
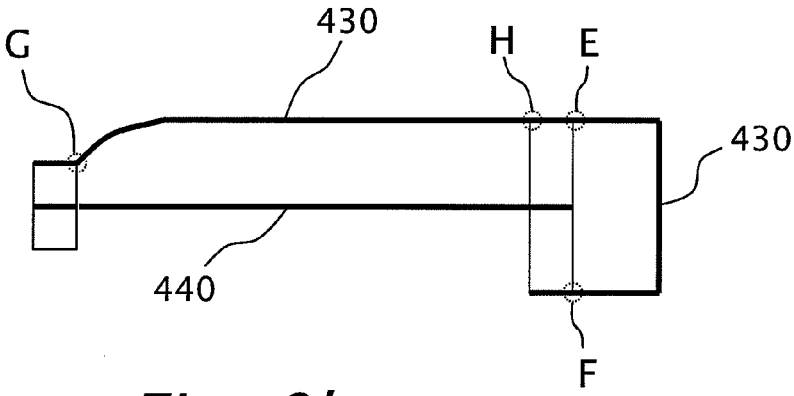
FIG. 9*b* is a top view of the single bottle holder shown in FIG. 9*a;*

Reference is now made to FIG. 9*a* which illustrates bottle holder 400, according to embodiments of the present invention, having an additional supporting strap 440. FIG. 9*b* is a top view of bottle holder 400 shown in FIG. 9*a*. Supporting strap 440 is typically non-elastic and is desirable if segment G-H of strap 430 is elastic.

Supporting strap 440 is attached either to both upper strap portion 412 and to upper strap portion 422, or to both lower strap portion 414 and to lower strap portion 424. Supporting strap 440 prevents the stretching of another bottle holder 400 when the second bottle holder 400 is connected to bottle holder 400. When a first bottle holder 400 is stretch to remove a bottle, the second bottle holder 400 connected to the first bottle holder 400 may also stretch and thereby accidentally drop the bottle the second bottle holder 400 holds. If segment G-H of strap 430 is not elastic the problem does not arise.

In embodiments of the present invention a label 450 can be placed on strap 440. Label 450 may serve as an advertising media. It should be noted the label may be placed not only on strap 440 but on any other surface of the bottle holder 400.

In embodiments of the present invention strap 440 may include one or more pouches or compartments to hold or store glasses, bottle openers, corks or any other thing.

Figure 10A:
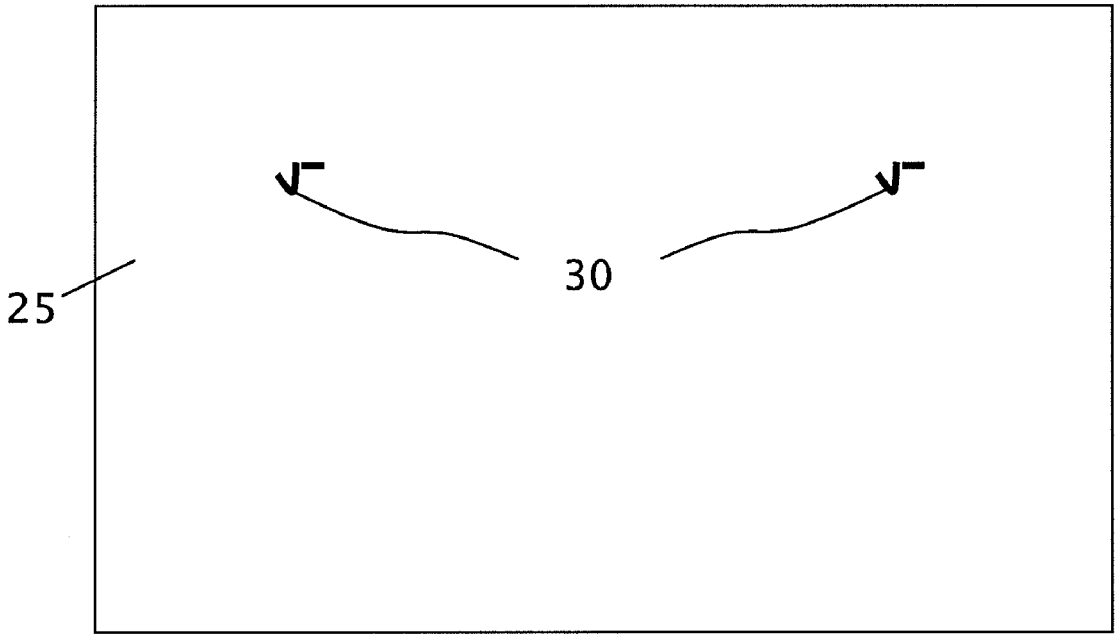
FIG. 10*a* illustrates a wall with two hooks affixed to the wall.
Figure 10B:
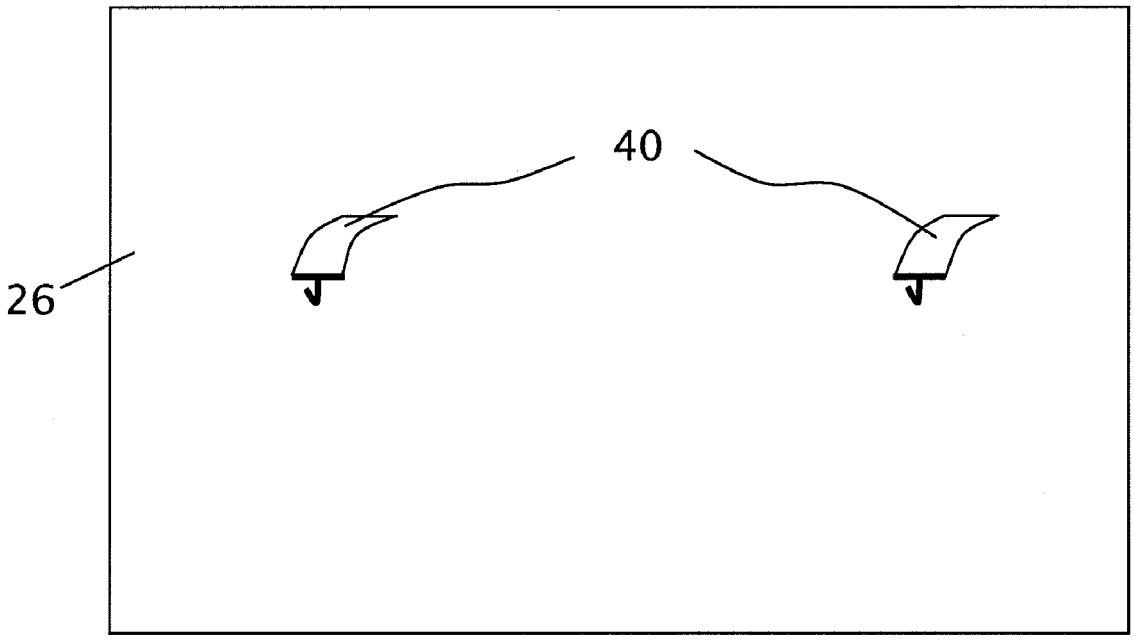
FIG. 10*b* illustrates a wall with two straps affixed to the wall, the straps having hooks.
Figure 11A:
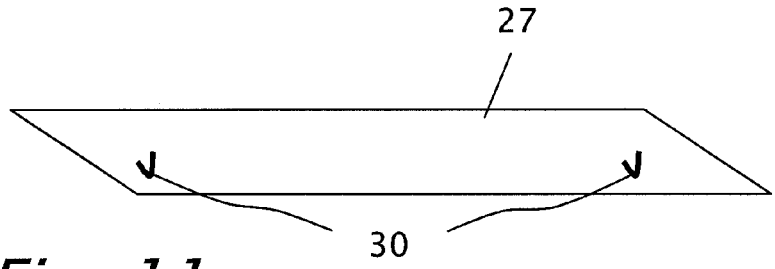
FIG. 11*a* illustrates a ceiling with two hooks affixed to the ceiling.
Figure 11B:
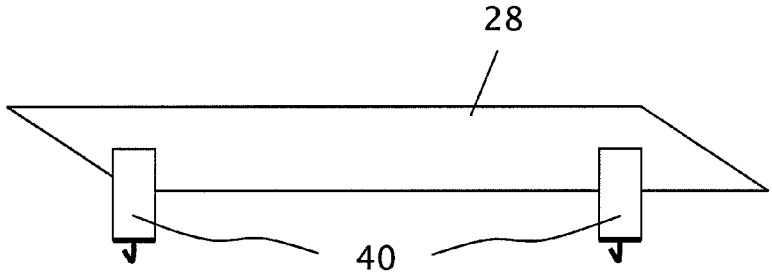
FIG. 11*b* illustrates a ceiling with two straps affixed to the ceiling, the straps having hooks.
Figure 11C:
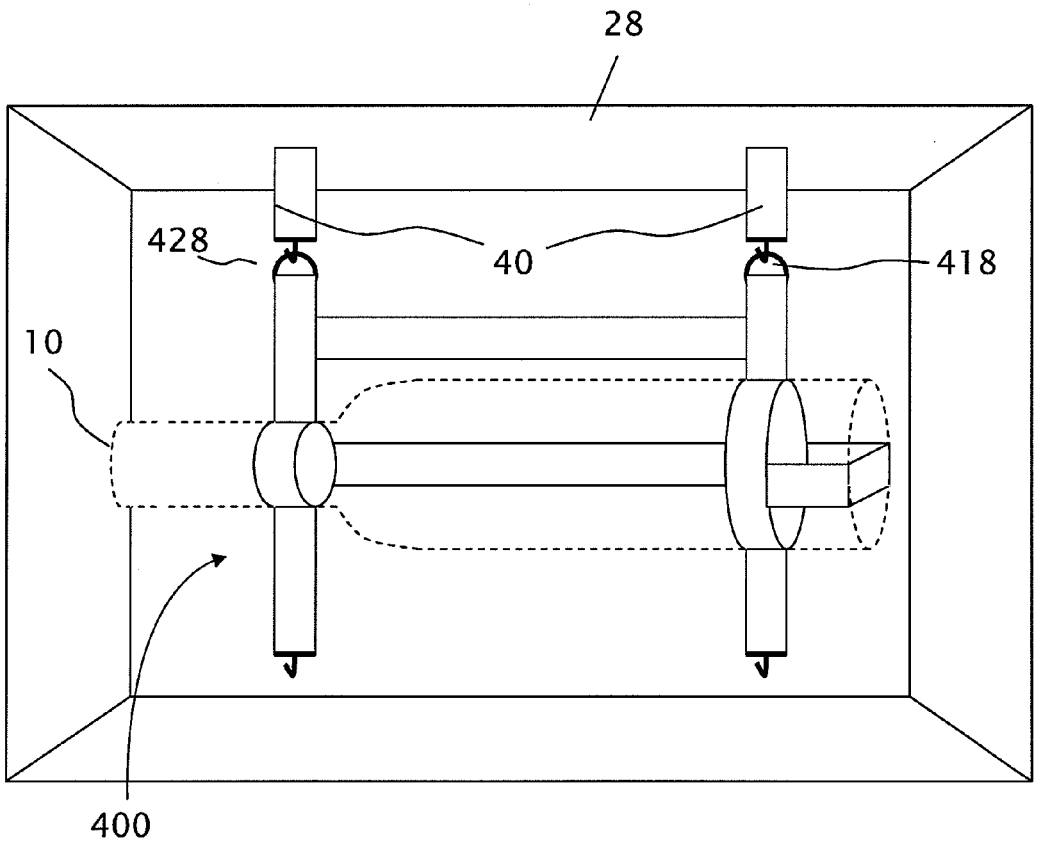
FIG. 11*c* illustrates a single bottle holder, as shown in FIG. 9*a*, attached onto straps affixed to a ceiling, as shown in FIG. 11*b;*

A bottle holder 400 can be attached to other one or more bottle holders 400 to form any desired configuration of a wine rack. The upper one or more bottle holders 400 are typically connected to hooks (or any other connecting means) which are affixed to a wall or a ceiling. FIG. 10*a* illustrates a wall 25 with two hooks 30 affixed to the wall. FIG. 10*b* illustrates a wall 26 with two straps 40 affixed to the wall, straps 40 having hooks. FIG. 11*a* illustrates a ceiling 27 with two hooks 30 affixed to the ceiling. FIG. 11*b* illustrates a ceiling 28 with two straps 40 affixed to the ceiling, straps 40 having hooks. FIG. 11*c* illustrates single bottle holder 400 attached onto straps 40 affixed to a ceiling 28.

Figure 12:
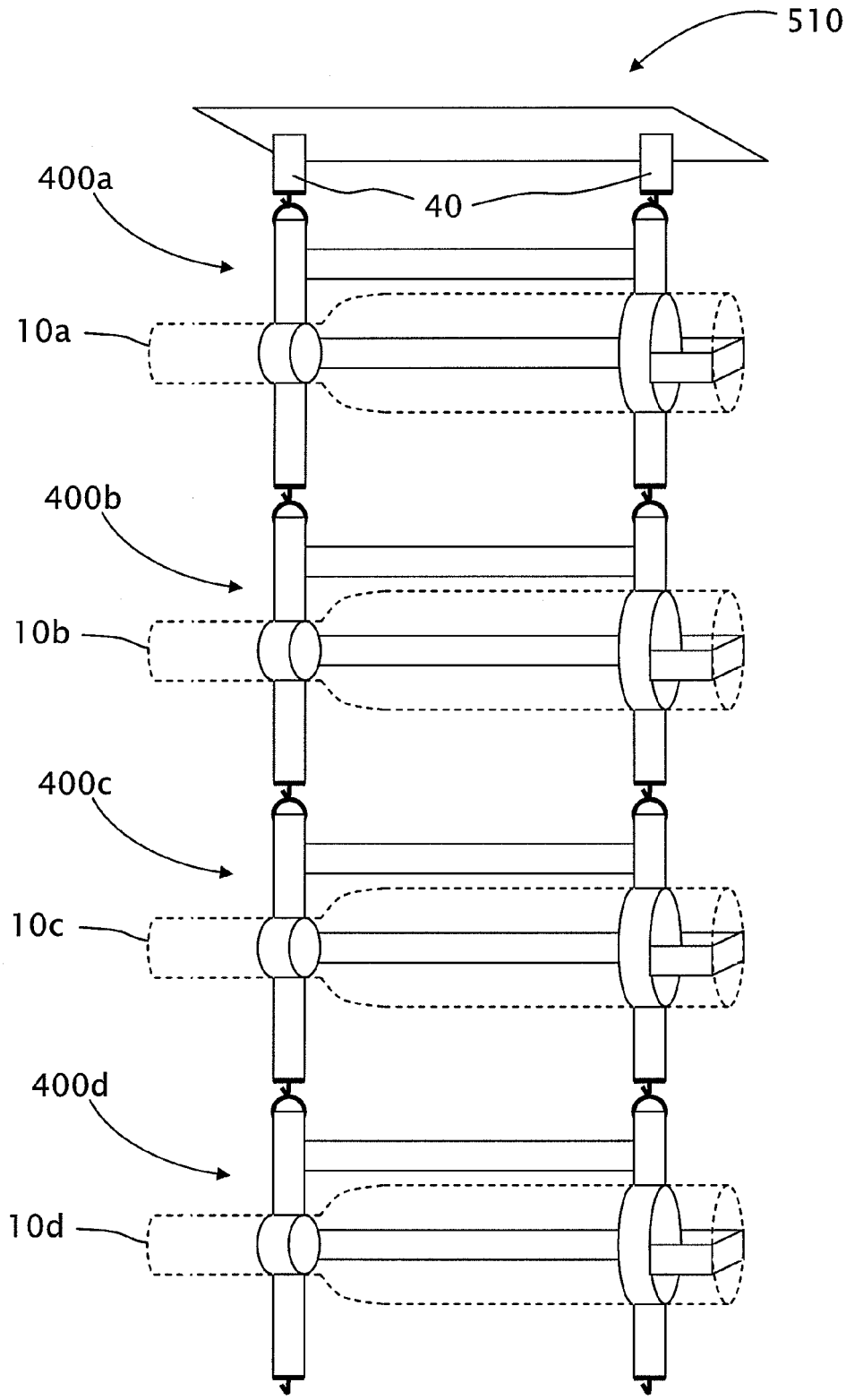
FIG. 12 illustrates a chain of four single bottle holders, as shown in FIG. 9*a*, attached onto straps affixed to a ceiling, as shown in FIG. 11*b;*
Figure 13:
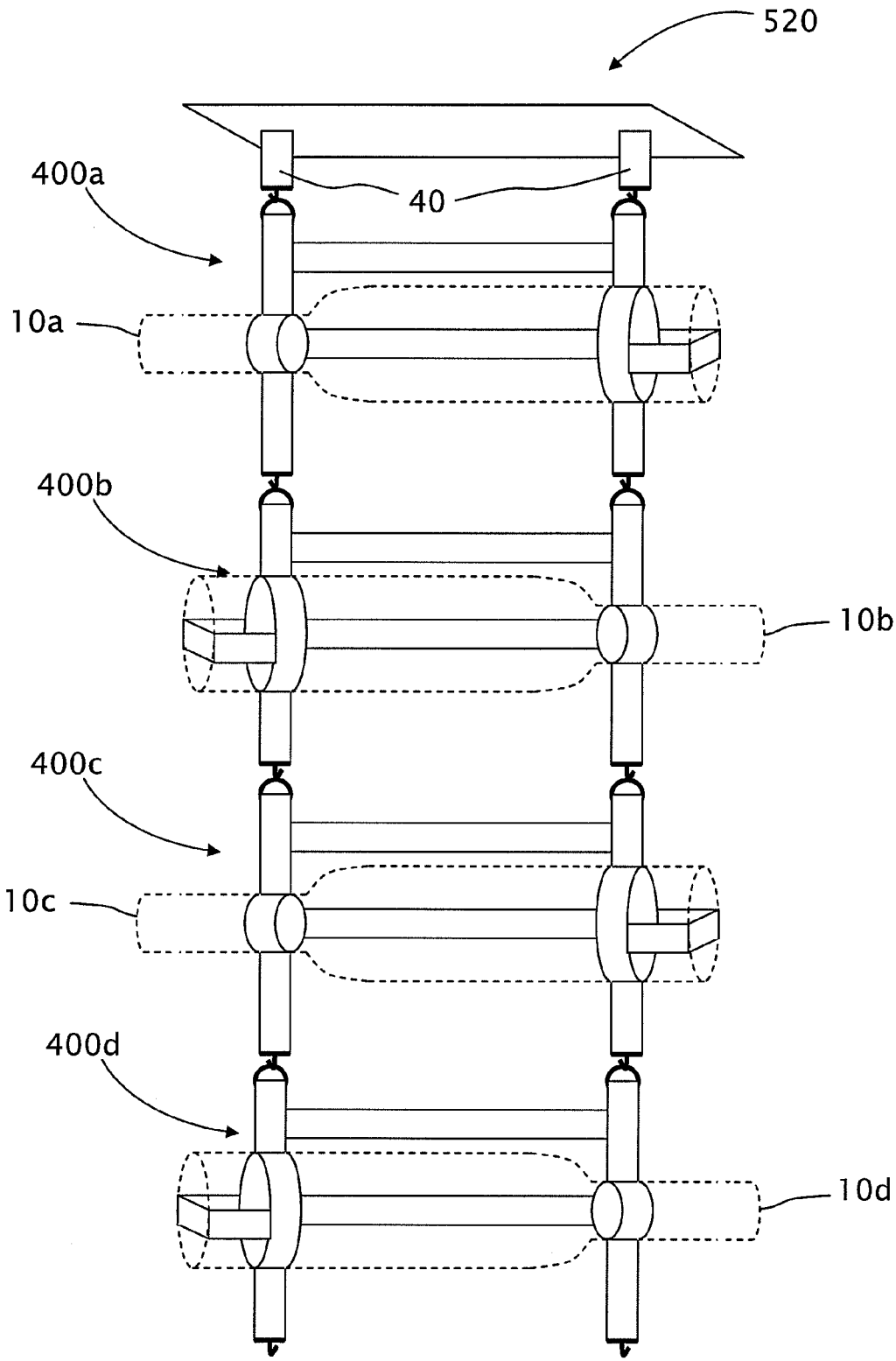
FIG. 13 illustrates a chain of four single bottle holders, as shown in FIG. 9*a*, attached onto straps affixed to a ceiling, as shown in FIG. 11*b*, the chain with a different configuration.

FIG. 12 illustrates a simple example configuration 510 including a chain of four single bottle holders 400 attached onto straps 40 affixed to a ceiling. FIG. 13 illustrates a simple example configuration 520 including a chain of four single bottle holders 400 attached onto straps 40 affixed to a ceiling, the chain having a different configuration. While in configuration 510 shown in FIG. 12 all bottles 10 point to the same direction, in FIG. 13 bottles 10 alternate in the direction they point to. When a chain of bottle holders is employed, one circumferential portion 419*a*, e.g. a half, of bottle base holding loop 416 and one circumferential portion 429*a*, e.g. a half, of bottle neck holding loop 426 (FIG. 7*b*) may be made of elastic or non-rigid material, while the remaining portions of the bottle base and neck holding loops may be made of a rigid material, to ensure that straps 410 and 420 will continue to be of the same length if a bottle is removed from one of the bottle holders.

Figure 14:
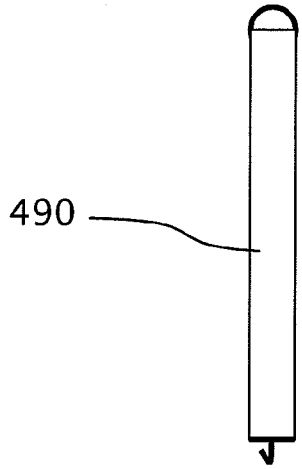
FIG. 14 illustrates a connecting strap, according to embodiments of the present invention.
Figure 15:
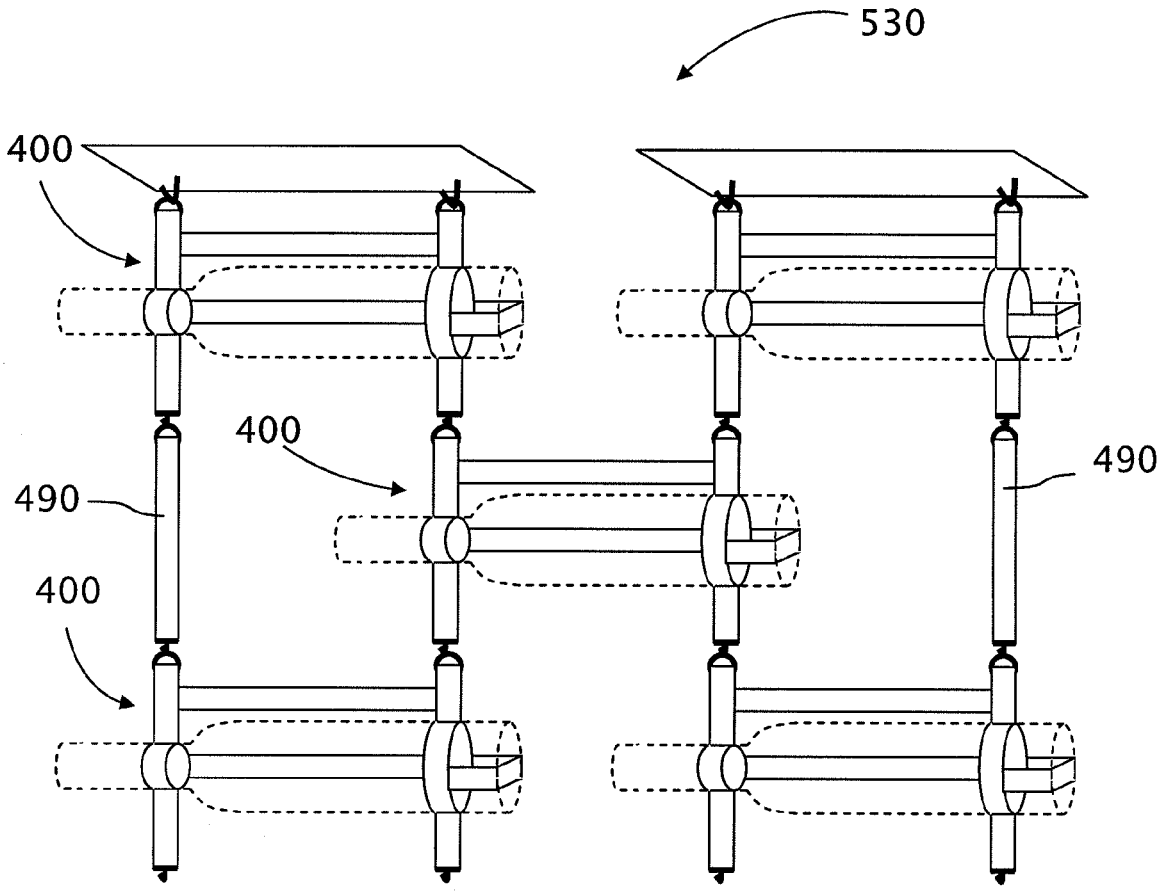
FIG. 15 illustrates an example configuration including five single bottle holders, as shown in FIG. 9*a*, and two connecting straps, as shown in FIG. 14, attached onto hooks affixed to a ceiling, as shown in FIG. 11*a*.

FIG. 14 illustrates a connecting strap 490, according to embodiments of the present invention. Connecting strap 490 is used to replace a single bottle holders 400 attached in a complex configuration, to enhance the configuration stability or due to esthetic considerations. FIG. 15 illustrates an example configuration 530 including five single bottle holders 400 and two connecting straps 490.

In embodiments of the present invention the straps 110/120 and/or loops 116/126 and/or straps 210/220 and/or loops 216/226 and/or straps 310/320 and/or loops 316/326 and/or straps 410/420 and/or loops 416/426 and/or strap 440 and/or other parts can be made of variety materials (such as metal, plastic or fabric) and the above mentioned straps can be in a variety of widths and thickness and can be made of clear or transparent materials.

In embodiments of the present invention configurations are made with fixed connections between bottle holders 100, 200, 300 or 400, thereby the configurations are constant and non-modular.

The above examples and description have of course been provided only for the purpose of illustration, and are not intended to limit the invention in any way. As will be appreciated by the skilled person, the invention can be carried out in a great variety of ways, employing more than one technique from those described above, all without exceeding the scope of the invention.

The invention claimed is:

1. A suspended bottle holder, comprising:

a. substantially vertically disposed first and second straps, each of which has an upper strap portion and a lower strap portion;

b. a bottle base holding loop having proximal and distal longitudinal ends, said bottle base holding loop being attached to the upper and lower portions of said first strap, for engaging at least a portion of a bottle base;

c. a bottle neck holding loop having proximal and distal longitudinal ends, said bottle neck holding loop being attached to the upper and lower portions of said second strap, for engaging at least a portion of a neck of said bottle base; and d. connecting means for connecting said first and second straps to a structural member, wherein said bottle base holding loop and said bottle neck holding loop are sufficiently spaced so as to maintain said bottle base in a substantially horizontal disposition.

2. The bottle holder according to claim 1, wherein the bottle base holding loop and the bottle neck holding loop are connected to the first and second straps, respectively, at one connection point.

3. The bottle holder according to claim 1, wherein the bottle base holding loop and the bottle neck holding loop are connected to the first and second straps, respectively, at two connection points.

4. The bottle holder according to claim 1, wherein the bottle base holding loop and bottle neck holding loop are made of elastic material.

5. The bottle holder according to claim 1, wherein the first and second straps are of a substantially equal length both when a bottle is removed from, or received in, the bottle base and bottle neck holding loops.

6. The bottle holder according to claim 5, wherein the bottle base holding loop and bottle neck holding loop are entirely or partially made of inelastic material.

7. The bottle holder according to claim 3, wherein the bottle base holding loop and the bottle neck holding loop are made of flexible inelastic material and the first and second straps are of a substantially equal length both when a bottle is removed from, or received in, the bottle base and bottle neck holding loops, the first and second straps being adapted to increase in length after the bottle is removed from the bottle base and bottle neck holding loops.

8. The bottle holder according to claim 1, further comprising a connecting strap for connecting the first and second straps.

9. The bottle holder according to claim 8, wherein the connecting strap has a segment substantially parallel to the longitudinal axis of the bottle.

10. The bottle holder according to claim 8, wherein the connecting strap is connected to both the bottle base holding loop and the bottle neck holding loop.

11. The bottle holder according to claim 10, wherein the connecting strap is connected at a first connecting point to a first circumferential portion of the bottle neck holding loop, at a second connecting point to a first circumferential portion of the bottle base holding loop, and at a third connecting point to a second circumferential portion of the bottle base holding loop, the first circumferential portion of each of the bottle base holding loop and of the bottle neck holding loop being on a common transversal side of the longitudinal axis of the bottle and the second circumferential portion of the bottle base holding loop being on a transversal side of the longitudinal axis of the bottle which is opposite to that of the first circumferential portion of the bottle neck holding loop.

12. The bottle holder according to claim 11, wherein the connecting strap longitudinally extends distally from the second connecting point, transversally extends to the second circumferential portion of the bottle base holding loop, and is connected by the third connecting point at the distal longitudinal end of the bottle base holding loop.

13. The bottle holder according to claim 12, wherein the second and third connecting points are common longitudinal ends of the bottle base holding loop.

14. The bottle holder according to claim 12, wherein the second and third connecting points are different longitudinal ends of the bottle base holding loop.

15. The bottle holder according to claim 12, wherein the connecting strap is further connected to the bottle base holding loop at a fourth connection point located at the distal longitudinal end of the first circumferential portion of the bottle base holding loop, the second connection point being located at the proximal longitudinal end of the first circumferential portion of the bottle base holding loop.

16. The bottle holder according to claim 15, wherein the length of the connecting strap, when not stretched, between the first and second connection points and between the third and fourth connection points is such that the bottle base is insertable in the bottle base holding loop and that the bottle neck is insertable in the bottle neck holding loop after the connecting strap is stretched.

17. The bottle holder according to claim 16, wherein a connection strap segment is inelastic between the first and second connection points.

18. The bottle holder according to claim 16, wherein a connection strap segment is inelastic between the third and fourth connection points.

19. The bottle holder according to claim 10, wherein the connecting strap is releasably attachable to the bottle neck holding loop or to the bottle base holding loop.

20. The bottle holder according to claim 1, wherein first and second circumferential portions of the bottle base holding loop or of the bottle neck holding loop are releasably attachable to each other.

21. A bottle holder system, comprising a plurality of bottle holders according to claim 11, wherein an upper bottle holder is connected to a structural member and a lower bottle holder is connected to a bottle holder located thereabove.

22. The bottle holder system according to claim 21, wherein each bottle holder further comprises a supporting strap attached to the upper strap portions of the first and second straps, respectively, or to the lower strap portions of the first and second straps, respectively.

23. The bottle holder according to claim 5, wherein approximately a half of the bottle base holding loop and approximately a half of the bottle neck holding loop are made of elastic or non-rigid material, while the remaining portions of the bottle base and neck holding loops are made of a rigid material.

* * * * *